US005209214A

United States Patent [19]

Ikuta et al.

[11] Patent Number: 5,209,214

[45] Date of Patent: May 11, 1993

[54] AIR FUEL RATIO CONTROL APPARATUS FOR ENGINE

[75] Inventors: Kenji Ikuta, Hekinan; Shohei Udo, Kawasaki, both of Japan

[73] Assignee: Nippondenso Co., Ltd., Kariya, Japan

[21] Appl. No.: 897,026

[22] Filed: Jun. 11, 1992

[30] Foreign Application Priority Data

Jun. 11, 1991 [JP] Japan ..... 3-139250

[51] Int. Cl.[5] ..... F02D 41/14; F02M 25/07

[52] U.S. Cl. ..... 123/698; 123/571

[58] Field of Search ..... 123/571, 679, 695, 696, 123/698

[56] References Cited

U.S. PATENT DOCUMENTS

| | | | |
|---|---|---|---|
| 4,364,227 | 12/1982 | Yoshida et al. | 123/695 X |
| 4,445,482 | 5/1984 | Hasegawa et al. | 123/679 |
| 4,640,257 | 2/1987 | Kodama et al. | 123/698 |
| 4,653,451 | 3/1987 | Kobayashi et al. | 123/698 X |
| 4,763,264 | 8/1988 | Okuno et al. | 123/698 X |
| 5,150,696 | 9/1992 | Kabasin et al. | 123/698 X |

FOREIGN PATENT DOCUMENTS

| | | | |
|---|---|---|---|
| 0185552 | 6/1986 | European Pat. Off. . | |
| 0312835 | 4/1989 | European Pat. Off. . | |
| 0110853 | 4/1989 | Japan . | |
| 055849 | 2/1990 | Japan . | |
| 0169836 | 6/1990 | Japan | 123/679 |
| 2109131 | 5/1983 | United Kingdom . | |

*Primary Examiner*—Willis R. Wolfe

*Attorney, Agent, or Firm*—Cushman, Darby & Cushman

[57] ABSTRACT

An air fuel ratio control apparatus for an engine equipped with an EGR device for refluxing a combustion gas from an exhaust pipe to an intake pipe and a fuel supply control device for controlling a fuel supply amount to the engine. The apparatus includes an air fuel ratio sensor for detecting an air fuel ratio of an air-fuel mixture to be introduced into said engine and an EGR rate sensor for detecting a reflux degree of the combustion gas to the intake pipe. In the apparatus a plurality of optimal feedback gains are set on the basis of a dynamic model of a system for controlling an air fuel ratio of an air-fuel mixture to the engine, and one of the plurality of set optimal feedback gains is selected in accordance with the reflex degree of the combustion gas detected by the EGR rate sensor. The apparatus determines a controlled amount of the fuel supply control device on the basis of the selected optimal feedback gain and the detected air fuel ratio so as to control the air fuel ratio for the engine to a target air fuel ratio. This arrangement can reduce the model error due to the EGR rate variation to improve the air fuel ratio control performance.

4 Claims, 6 Drawing Sheets

AIR FUEL RATIO CONTROL APPARATUS FOR ENGINE

BACKGROUND OF THE INVENTION

The present invention relates to an air fuel ratio control apparatus for controlling a fuel injection amount so that the air fuel ratio of an air-fuel mixture to be supplied into an engine becomes a theoretical air fuel ratio, and more particularly to an air fuel ratio control apparatus for controlling the air fuel ratio with a rapid response (high responsibility) irrespective of variation of the EGR rate.

Generally, in accordance with the so-called modern control theory, such an air fuel ratio control apparatus is arranged to construct a dynamic model of a system for controlling the engine air fuel ratio on the basis of an approximation of an auto regressive model having a degree of 1 and having a dead time P (P=0, 1, 2, . . . ) and in consideration of disturbances so as to determine an air fuel ratio control amount on the basis of an state variable and an optimal feedback gain predetermined on the basis of the dynamic model. The optimal feedback gain is determined so that the responsibility is compatible with the stability under various operating conditions, for example, as disclosed in the Japanese Patent Provisional Publication No. 1-110853. Further, for preventing an oxygen ($O_2$) sensor output from being shifted to a rich side with respect to the actual density due to the ununiformity of the distribution of the exhaust reflux to the respective cylinders of the engine so as not to control the air fuel ratio to the lean side, when performing the exhaust reflux, the integration constant or the skip amount is switched to a value so that the air fuel ratio tends to become at the rich side as disclosed in the Japanese Patent provisional Publication No. 2-55849 (where the air fuel ratio control is based on the PI control). However, there is a problem which arises with such an air fuel ratio control apparatus based on the modern control theory in that the dynamic model of the engine varies in accordance with the EGR rate. More specifically, as shown in FIG. 7, in the case that the combustion gas flows back (ERG-ON), the time constant (the variation of the air fuel ratio A/F relative to the variation of the air fuel ratio correction coefficient FAF) becomes longer as compared with the case that it does not flow back (EGR-OFF), because the variation of the air fuel ratio determined by the injection amount and air newly sucked is averaged with the air fuel ratio of the combustion gas introduced into the intake system. Thus, if performing the air fuel ratio control in areas, different in EGR rate from each other, on the basis of the feedback gain produced in accordance with the same model, there is the possibility that the air fuel ratio control performance deteriorates due to the model error. In addition, in the case that like the above-described conventional apparatus the air fuel ratio is merely controlled to be inclined to the rich side, when effecting the air fuel ratio control in accordance with the modern control, it is impossible to eliminate the deterioration of the air fuel ratio control performance due to the lag of the responsibility caused by the EGR rate variation.

SUMMARY OF THE INVENTION

It is therefore an object of the present invention to provide an air fuel ratio control apparatus which is capable of adequately controlling the air fuel ratio irrespective of the variation of the EGR rate.

In accordance with the present invention, there is provided an air fuel control apparatus for an engine, comprising: means for detecting an air fuel ratio of an air-fuel mixture to the engine; means for controlling a fuel supply amount to the engine; means for recirculating an exhaust gas from an exhaust pipe of the engine to an intake pipe thereof; means for detecting a degree of the recirculation of the exhaust gas made by the exhaust gas recirculating means; means for determining a controlled amount of the fuel supply amount control means on the basis of an optimal feedback gain set on the basis of a dynamic model of the engine and the air fuel ratio detected by the air fuel ratio detecting means so as to control the air fuel ratio in the engine to a target air fuel ratio; means for setting a plurality of optimal feedback gains in accordance with the degree of the reflux detected by the exhaust gas recirculating degree detecting means; and means for performing a switching operation between the plurality of feedback gains in accordance with the degree of the reflux detected by the exhaust gas recirculating degree detecting means.

Further, according to this invention, there is provided an air fuel ratio control apparatus for an engine equipped with means for recirculating an exhaust gas from an exhaust pipe to an intake pipe, the apparatus comprising: means for detecting an air fuel ratio of an air-fuel mixture to be introduced into the engine; means for controlling a fuel supply amount to the engine; means for detecting a degree of the exhaust gas which is recirculated to the intake pipe; means for setting a plurality of optimal feedback gains on the basis of a dynamic model of a system for controlling an air fuel ratio of an air-fuel mixture to the engine; means for selecting one of the plurality of set optimal feedback gains in accordance with the circulation degree of the exhaust gas detected by the exhaust gas recirculating degree detecting means; and means for determining a controlled amount of the fuel supply control means on the basis of the optimal feedback gain selected by the optimal feedback gain selecting means and the air fuel ratio detected by the air fuel ratio detecting means so as to control the air fuel ratio for the engine to a target air fuel ratio.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
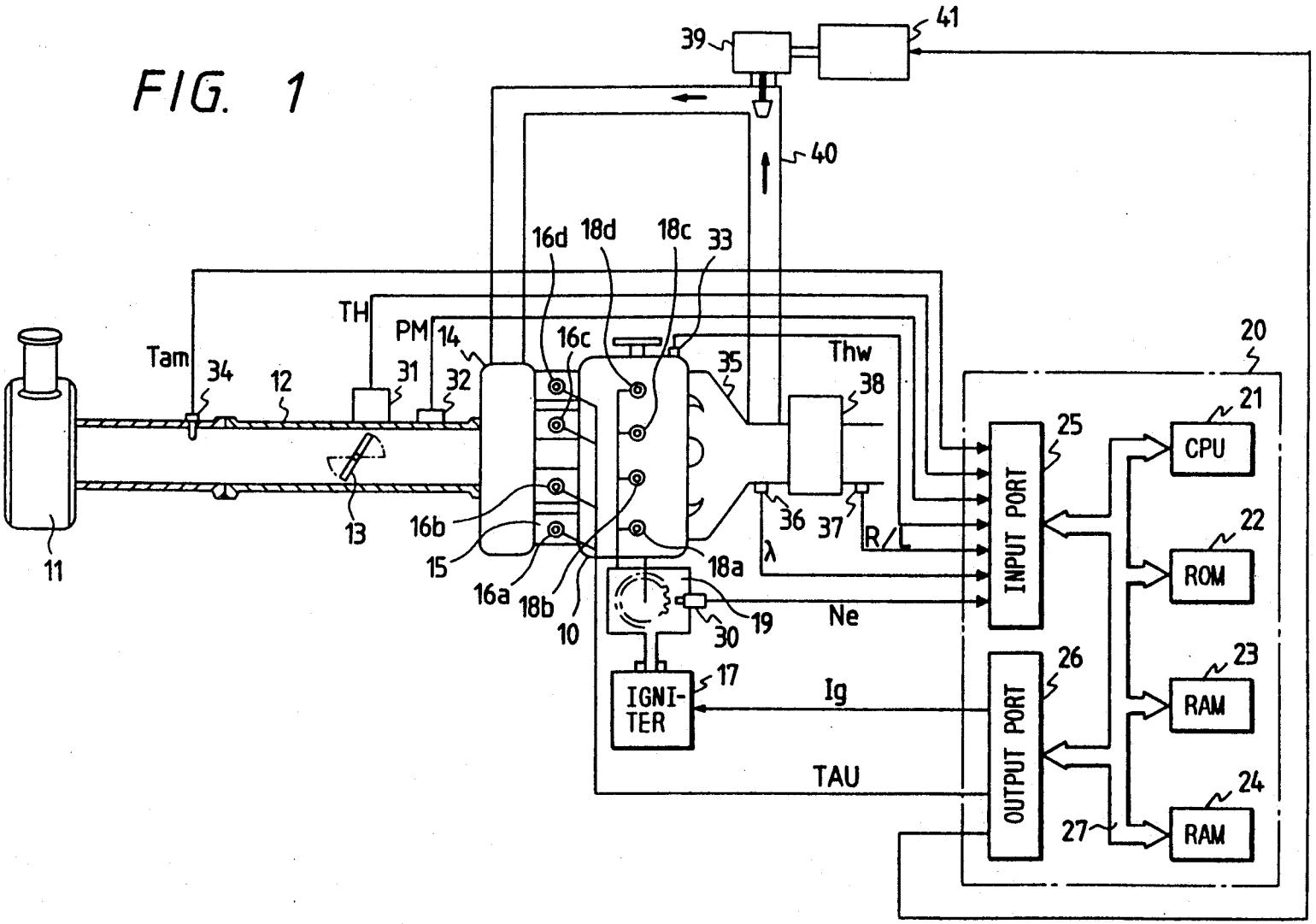
FIG. 1 is an illustration of an air fuel ratio control apparatus according to an embodiment of the present invention which is used for an engine.

Referring now to FIG. 1, there is illustrated an arrangement of an air fuel ratio control apparatus according to an engine of the present invention which is used for an engine designated at numeral 10. In FIG. 1, the engine 10 is of the 4-cylinder 4-cycle spark ignition type where the intake air is introduced through an air cleaner 11, an intake pipe 12, a throttle valve 13, a serge tank 14 and an intake branch pipe into each of the cylinders. Further, the fuel supplied under pressure from a fuel tank (not shown) is injected and supplied through the fuel injection valves 16*a* to 16*d* provided in the intake branch pipe 15 thereinto. In addition, the engine 10 is equipped with distributor 19 for distributing a high-voltage electric signal from an igniter 17 to ignition plugs 18*a* to 18*d* for the respective cylinders, a rotational speed sensor 30 for sensing the rotational speed Ne of the engine 10 provided within the distributor 19, a throttle sensor 31 for sensing the opening degree TH of a throttle valve 13, an intake pressure sensor 32 for sensing the intake pressure PM at a downstream portion of the throttle valve 13, a water temperature sensor 33 for sensing the temperature Thw of the cooling water for the engine 10, and an intake air temperature sensor 34 for sensing the intake air temperature Tam. The rotational speed sensor 30 is provided in opposed relation to a ring gear rotatable in synchronism with a crank shaft of the engine 10 so as to output a pulse signal, comprising 24 pulses per two revolutions of the engine 10, i.e., 720° CA, in proportion to the rotational speed Ne of the engine 10. Further, the throttle sensor 31 outputs an analog signal corresponding to the throttle opening degree TH and further outputs ON-OFF signals from an idle switch for detecting that the throttle valve 13 is in the full-closed state. Moreover, in an exhaust pipe 35 of the engine 10 there is provided a catalytic converter rthodium 38 for reducing the hazardous components (CO, HC, NOx and others) included in the exhaust gas to be discharged from the engine 10. At an upstream portion of the catalytic converter rthodium 38 there is provided an air fuel ratio sensor 36 which is a first oxygen density sensor for outputting a linear detection signal corresponding the air fuel ratio λ of the air-fuel mixture supplied into the engine 10, and at a downstream portion of the catalytic converter rthodium 37 there is provided an $O_2$ sensor which is a second oxygen density sensor for outputting a detection signal corresponding to the fact that the air fuel ratio λ of the air-fuel mixture supplied into the engine 10 is at the rich side or lean side with respect to the theoretical air fuel ratio.

Designated at numeral 40 is an EGR pipe for recirculating the exhaust gas to the intake branch pipe 15, and in this EGR pipe 40 there is provided an EGR valve 39 for adjusting the amount of the exhaust gas to be recirculated. The EGR valve 39 is arranged such that its opening degree is controlled by a vacuum modulator 41, operated in accordance with a control signal from an electronic control Unit (ECU) 20, so as to take an EGR rate predetermined in accordance with the operating state (for example, the intake pipe pressure and the engine rotational speed). The electronic control unit 20 is for performing various control such as the ignition timing Ig, fuel injection amount. The electronic control unit 20 includes a CPU 21, a ROM 22, a RAM 23, a backup RAM 24 and others so as to construct an arithmetic and logic calculation unit and further includes an input port 25 for inputting signals from the above-mentioned various sensors and an output port 26 for outputting control signals to the actuators. These constituting elements are coupled through a common bus 27 to each other.

The electronic control unit 20 inputs, through the input port 25, the intake pressure PM, intake air temperature Tam, throttle opening degree TH, cooling water temperature Thw, air fuel ratio λ, rotational speed Ne and others so as to calculate the fuel injection amount TAU, ignition timing Ig and EGR rate on the basis of the inputted data to output, through the output port 26, the corresponding control signals to the fuel injection valves 16*a* to 16*d*, igniter 17 and vacuum modulator 41, respectively. A description will be made hereinbelow in terms of the air-fuel ratio control executed in accordance with the opening degree of the EGR valve 39. Here, for performing the air fuel ratio control, the electronic control unit 20 is in advance designed in accordance with the following technique which is disclosed in the Japanese Patent provisional Publication No. 1-110853, for example.

1) Modeling of Controlled Object

In this embodiment an autoregressive moving average model whose degree is 1 and dead time P is 3 is used for a model of the system for controlling the air fuel ratio λ in the engine 10 and approximated by taking into account a disturbance d. First, the model of the air fuel ratio λ controlling system based on the autoregressive moving average model can be approximated by the following equation.

$$\lambda(k)=a\cdot\lambda(k-1)+b\cdot FAF(k-3) \quad (1)$$

where λ represents an air fuel ratio, FAF depicts an air fuel ratio correction coefficient, a, b denote constants, and k is a variable showing the number of repetitions of the control counted from the first sampling start.

If taking into account the disturbance d, the control system model can be approximated as follows.

$$\lambda(k)=a\cdot\lambda(k-1)+b\cdot FAF(k-3)+d(k-1) \quad (2)$$

By using a step response, it is easy to obtain the constants a and b by effecting the discrete operation with the rotational period (360° CA) sampling with respect to the model thus approximated, i.e., obtain the transfer function G of the system for controlling the air fuel ratio.

2) Indicating method of State Variable IX (IX represents a vector quantity)

If rewriting the above-mentioned equation (2) by using the state variable $IX(k)=[X_1(k), X_2(k), X_3(k), X_4(k)]^T$ (where T represents a transposed matrix) . . . (3), the following equation can be obtained.

$$\begin{bmatrix} X_1(K+1) \\ X_2(K+1) \\ X_3(K+1) \\ X_4(K+1) \end{bmatrix} \begin{bmatrix} ab00 \\ 0010 \\ 0001 \\ 0000 \end{bmatrix} \begin{bmatrix} X_1(K) \\ X_1(K) \\ X_1(K) \\ X_1(K) \end{bmatrix} \begin{bmatrix} 0 \\ 0 \\ 0 \\ 0 \end{bmatrix} FAF(K) + \begin{bmatrix} 1 \\ 0 \\ 0 \\ 0 \end{bmatrix} d(K) \quad (4)$$

That is, $$X_1(K+1)=aX_1(K)+bX_1(K)+d(K)=\lambda(K+1)$$

$$X_2(K+1)=FAF(K-2)$$

$$X_3(K+1)=FAF(K-1)$$

$$X_4(K+1)=FAF(K) \quad (5)$$

3) Design of Regulator

When designing the regulator in terms of the aforementioned equations (3) and (4), if using the following the optimal feedback gain IK (vector quantity) and state variable $IX^T$:

$$IK=[K1,K2,K3,K4] \quad (6)$$

$$IX^T(k)=[\lambda(k),FAF(k-3),FAF(k-2),FAF(k-1)] \quad (7)$$

the following equation can be obtained:

$$FAF(k)=IK\cdot IX^T(k)=K_1\cdot\lambda(k)+K_2\cdot FAF(k-3)+K_3\cdot FAF(k-2)+K_4\cdot(k-1) \quad (8)$$

Further, an integrating term ZI(k) is added to the aforementioned equation (8) to obtain the following equation, thus obtaining the air fuel ratio λ and the correction coefficient FAF.

$$FAF(k)=K_1\cdot\lambda(k)+K_2\cdot FAF(k-3)+K_3\cdot FAF(k-2)+K_4\cdot(k-1)+ZI(k) \quad (9)$$

Here, the integrating term ZI(k) is a value determined by the deviation between the target air fuel ratio $\lambda_{TG}$ and the actual air fuel ratio λ(k) and an integrating constant Ka and can be obtained in accordance with the following equation.

$$ZI(k)=ZI(k-1)+Ka\cdot(\lambda_{TG}-\lambda(k)) \quad (10)$$

Figure 5:
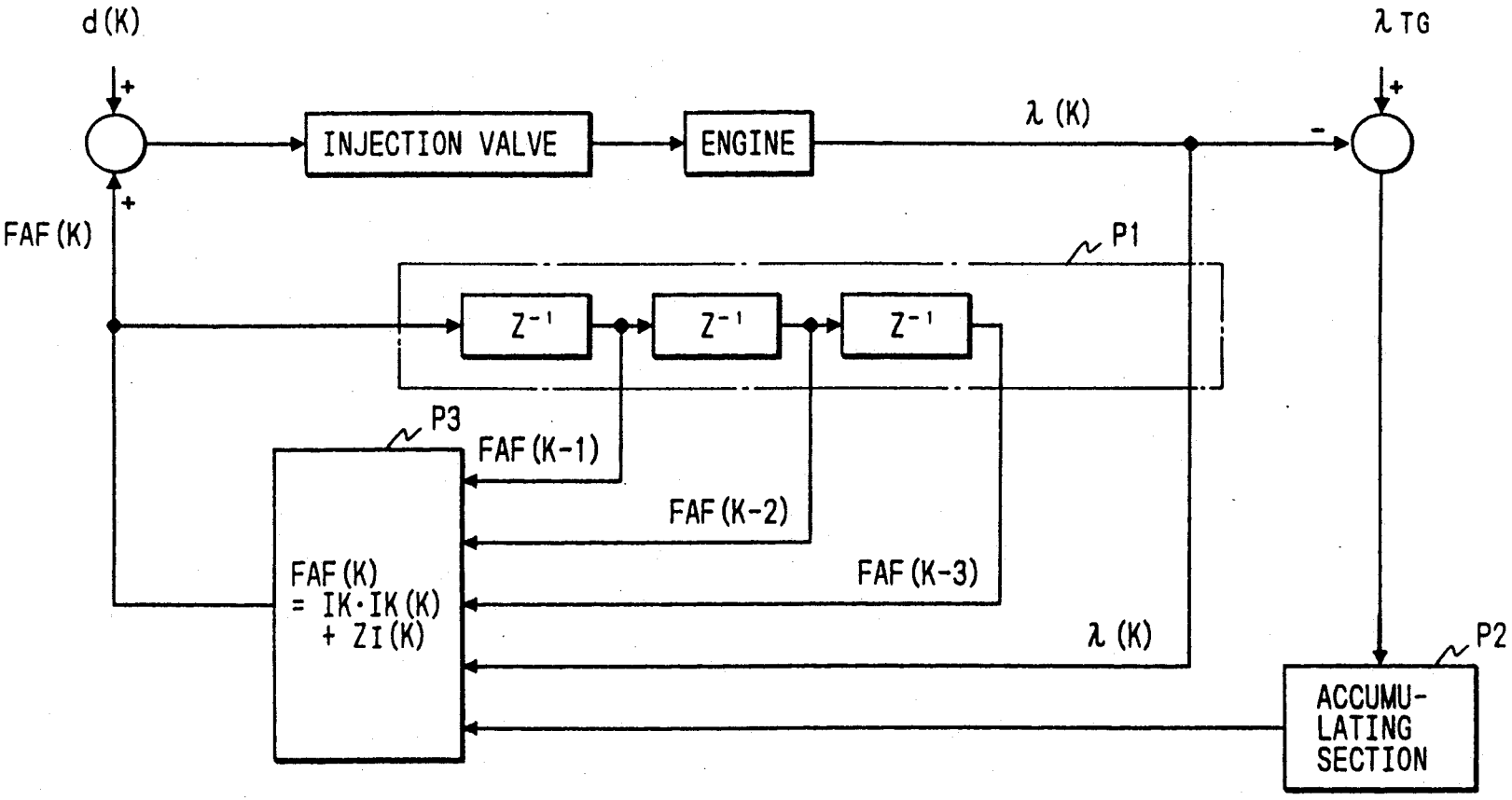
FIG. 5 is a block diagram showing a model of a system for controlling the air fuel ratio of an air-fuel mixture to an engine.

FIG. 5 is a block diagram showing the air fuel ratio λ controlling system designed as described above. Here, the system is indicated using the $Z^{-1}$ conversion so as to obtain the air fuel ratio correction coefficient FAF(k) from the correction coefficient FAF(k−1). The past air fuel ratio correction coefficient FAF(K−1) is previously stored in the RAM 23 and read out at the next control timing. In FIG. 5, a block P1 surrounded by a chain line represents a portion for determining the state variable IX(k) in the state that the air fuel ratio λ(k) is feedback-controlled to the target air fuel ratio $\lambda_{TG}$, a block P2 denotes a portion (accumulation portion) for obtaining the integrating term ZI(k), and a block P3 is a portion for calculating the present air fuel ratio correction coefficient FAF(k) on the basis of the state variable IX(k) obtained in the block P1 and the integrating term ZI(k) obtained in the block P2.

4) Determination of Optimal Feedback Gain IK and Integrating Constant Ka

The optical feedback gain IK and the integrating constant Ka can be set by minimizing the evaluation function J expressed by the following equation, for example.

$$J=\Sigma\{Q\,(\lambda(k)-\lambda_{TG})^2+R\,(FAF(k)-FAF(k-1))^2\} \quad (k=0 \text{ to } \infty) \quad (11)$$

Here, the evaluation function J is for minimizing the deviation between the air fuel ratio λ(k) and the target air fuel ratio $\lambda_{TG}$ with the variation of the air fuel ratio correction coefficient FAF(k) being constrained. The weighting of the constraint for the air fuel ratio correction coefficient FAF(k) can be changed by changing the values of the weighting parameters Q and R. Accordingly, the simulation is repeatedly effected by changing the weighting parameters Q and R so as to obtain the optimal control characteristic, thereby determining the optimal feedback gain IK and the integrating constant Ka.

Further, since the optimal feedback gain IK and the integrating constant Ka depend upon the model constants a and b, for ensuring the stability of the system against the variation (parameter variation) of the system for controlling the actual air fuel ratio λ, the optimal feedback gain IK and the integrating constant Ka are required to be designed in anticipation of the variations of the model constants a and b. According to this embodiment in which the model is switched in accordance with the EGR rate, for example, in the case that the model switching is effected under the condition that the EGR rate centers round 15%, the simulation is performed under the respective operating conditions by adding the variation of the model constants a and b, which can actually taken, thus determining the optimal feedback gains IKEH, IKEL and the integrating constant Ka.

Although a description has been made hereinabove in terms of the operations 1) to 4), the electronic control unit 20 performs the control by using the results, i.e., the equations (9) and (10).

Figure 2:
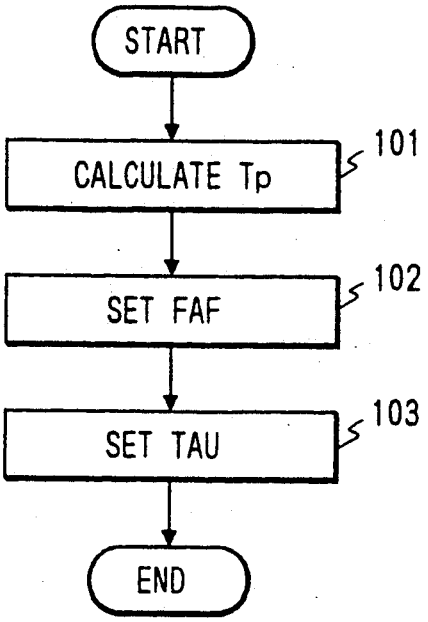
FIGS. 2 to 4 are flow charts for describing a control operation to be executed by the FIG. 1 air fuel ratio control apparatus.
Figure 3:
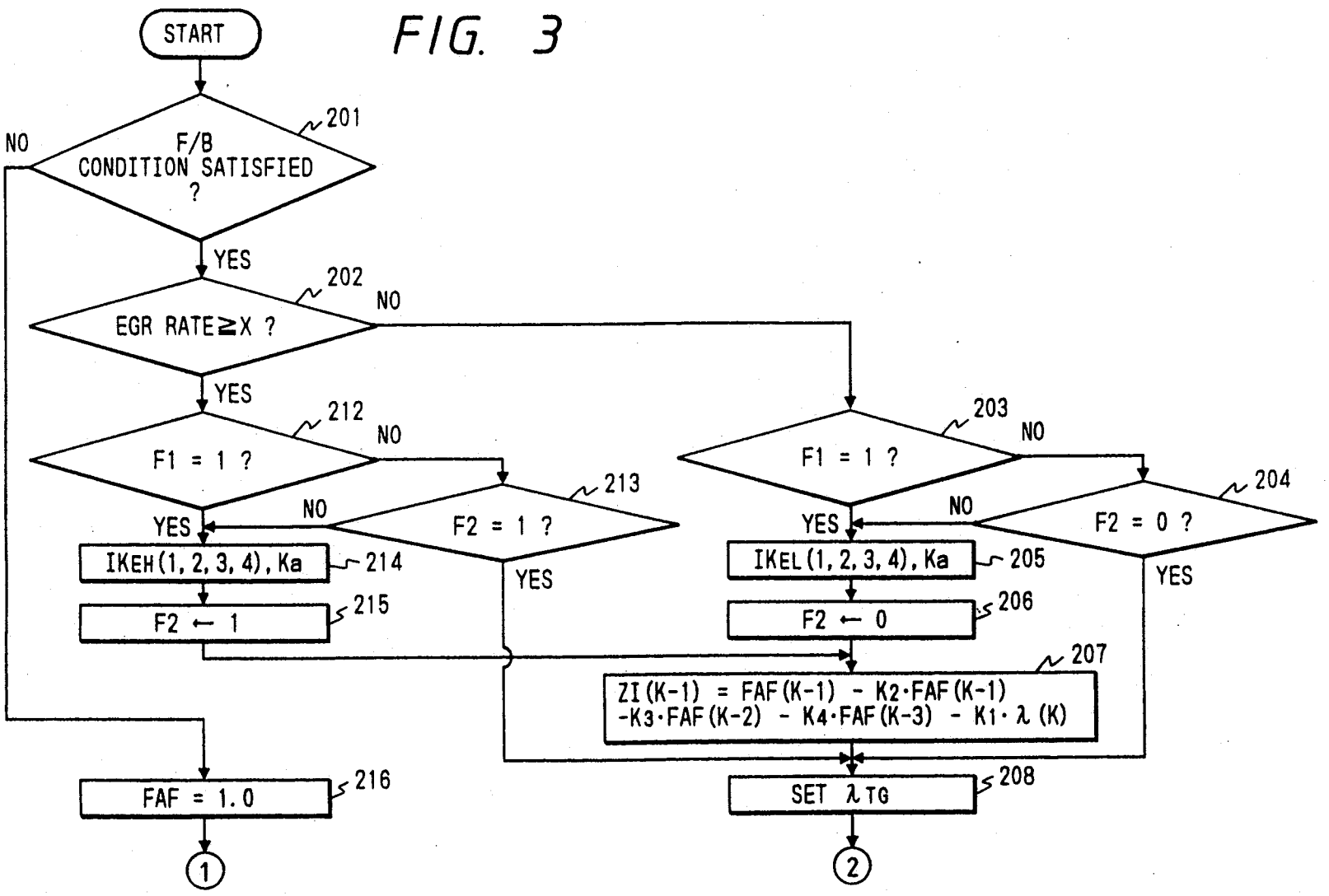
Figure 4:
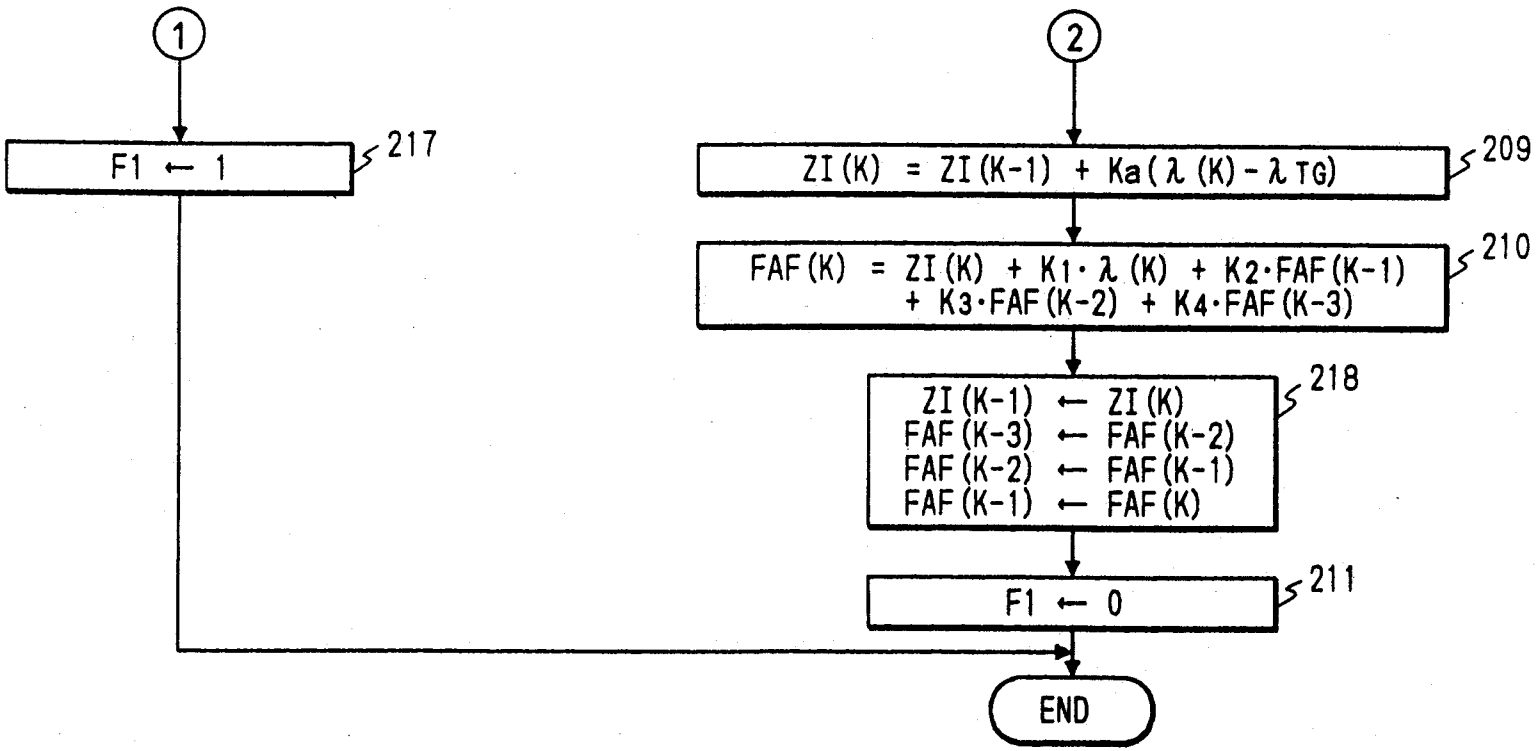

The air fuel ratio control in this embodiment will be described hereinbelow with reference to FIGS. 2 to 4. FIG. 2 is a flow chart showing an operation for setting the fuel injection amount TAU which operation is performed in synchronism with the rotation (at every 360° CA). In FIG. 2, the operation starts with a step 101 to calculate a basic fuel injection amount Tp on the basis of the intake pressure PM, the rotational speed Ne and others, then followed by a step 102 to set an air fuel ratio correction coefficient FAF so that the air fuel ratio λ becomes equal to the target air fuel ratio $\lambda_{TG}$ (which will be described hereinafter). Then, a step 103 follows to set a fuel injection amount TAU on the basis of the basic fuel injection amount Tp, the air fuel ratio correction coefficient FAF and a different correction coefficient FALL in accordance with the following equation.

$$TAU=FAF\times Tp\times FALL \quad (12)$$

Each of operating signals corresponding to the fuel injection amount TAU thus set is outputted to each of the fuel injection valves **16*a* to 16*d***.

Figure 6:
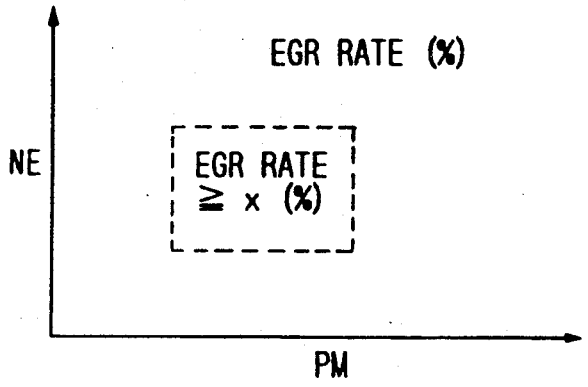
FIG. 6 is a graphic illustration for describing a detection of EGR rate.
Figure 7:
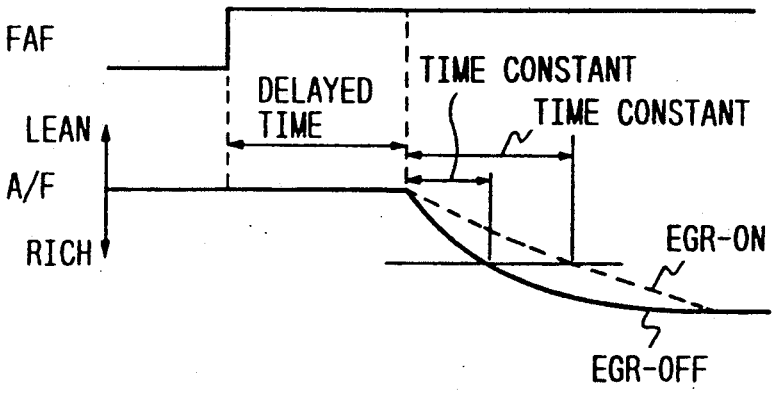
FIG. 7 PRIOR ART
FIG. 7 is a graphic illustration for describing a conventional air fuel ratio control apparatus.

Secondly, a description will be made hereinbelow with reference to FIGS. 3 and 4 in terms of the setting (the step 102 in FIG. 2) of the air fuel ratio correction coefficient FAF. First, a step 201 is executed in order to check whether the feedback condition of the air fuel ratio λ is satisfied. The feedback condition is, for example, that the cooling water temperature Thw is above a predetermined value and the engine is not in a high-load state or a high-speed state. If no satisfaction, the operational flow goes to a step 216 to set the air fuel ratio correction coefficient FAF to 1.0 and then advances to a step 217 to set an open control decision flag F1 to "1", thereafter terminating this routine. That is, the fuel injection amount TAU is set in accordance with the open control in the step 103 of FIG. 2 without performing the feedback control. On the other hand, If in the step 210 the feedback condition is satisfied, the operation proceeds to a step 202 to check whether the EGR rate exceeds a predetermined value. In this embodiment, as illustrated in FIG. 6, the EGR rate is determined in accordance with a two-dimensional map of the engine speed NE and the intake pressure PM, and the area that the EGR rate is above the predetermined value x (for example, 15%) corresponds to a portion surrounded by a dotted line in FIG. 6. Accordingly, it is possible to check, on the basis of the intake pressure PM and the engine speed NE, whether the EGR rate exceeds the predetermined value. If the answer of the step 202 is "NO", the operation goes to a step 203 to check whether the previous control is the open control because of no satisfaction of the feedback condition, that is, to check whether the open control decision flag F1=1. If F1=1 indicative of the fact that the previous control is the open control, a step 205 follows to set the optimal feedback gain and the integrating constant to predetermined $IK_{EL}$ (1, 2, 3, 4) and Ka, then followed by a step 206 to set a feedback gain decision flag F2 to "0". Subsequently, in a step 207 the initial value ZI(K−1) of the integrating term is calculated in accordance with the following equation.

$$ZI(K-1)=FAF(K-1)-K_2\cdot FAF(K-1)-K_3\cdot FAF(K-2)-K_4\cdot FAF(k-3)-K_1\cdot\lambda(K) \quad (13)$$

where λ(K) represents an air fuel ratio.

This equation (13) corresponds to the inverse calculation of an FAF calculation to be effected in a step 210. Here, the optimal feedback gain $IK_{EL}$ is determined by setting Q/R of the evaluation function J in the above-mentioned equation (11) to 1/5 in terms of an air fuel ratio model whose dead time is 3 rev and time constant is 4.5 rev. Further, an optimal feedback gain IKEH (which will be described hereinafter) is determined by setting Q/R of the evaluation function J to 1/5 in terms of a slower-responsibility air fuel ratio model whose dead time is 3 rev and time constant is 6.5 rev.

On the other hand, if the answer of the step 203 is that the previous control is not the open control, i.e., F1=0, the operation advances to a step 204 to check, in accordance with the feedback gain decision flag F2, whether the previous optimal feedback gain is $IK_{EL}$, that is, check whether it is required to switch the optimal feedback gain IK. If F2=1 indicative of the fact that the previous optimal feedback gain is set to $IK_{EH}$, since the present optimal feedback gain IK is required to be switched to $IK_{EL}$, the operation goes to the step 205 to set the optimal feedback gain IK to $IK_{EL}$, then followed by the 206 to reset the flag F2 and further followed by the step 207 to calculate the initial value ZI(K−1) of the integrating term, thereafter advancing to a step 208.

If the decision of the step 204 is that the previous control is the feedback control as that the previous optimal feedback gain IK is $IK_{EL}$ (F2=0) as well as the present optimal feedback gain IK, the operational flow directly goes to the step 208 without executing the steps 205 to 207. The step 208 is for setting the target air fuel ratio $\lambda_{TG}$. The target air fuel ratio $\lambda_{TG}$ is normally set to 1 (theoretical air fuel ratio) and set to the rich side in accordance with the operating state such as an accelerating state and a high-load state.

After the execution of the step 208, a step 209 follows to calculate the integrating term ZI(K) in accordance with the following equation.

$$ZI(K)=ZI(K-1)+Ka\cdot(\lambda(K)-\lambda_{TG}) \quad (14)$$

Further, the step 210 is executed in order to calculate the air fuel ratio correction coefficient FAF in accordance with the following equation.

$$FAF(K)=ZI(K)+K1\cdot\lambda(K)+K2\cdot FAF(K-1)+K3\cdot FAF(K-2)+K4\cdot FAF(K-3) \quad (15)$$

Still further, a step 218 is executed to rewrite the respective variables ZI(K), FAF(K−2), FAF(K−1) and FAF(K) to ZI(K−1), FAF(K−3), FAF(K−2) and FAF(K−1), and a step 211 then follows to set the open control decision flag F1 to "0", thereafter termininating this routine.

On the other hand, if the decision of the step 202 is that the present EGR rate is above the predetermined value x, a step 212 is executed to check, in accordance with the open control decision flag F1, whether the previous control is the open control due to no satisfaction of the feedback condition. If F1=1 indicative of the fact that the previous control is the open control, a step 214 follows to set the optimal feedback gain and the integrating constant to $IK_{EH}$ (1, 2, 3, 4) and Ka, respectively. Here, as described above, $IK_{EH}$ is a value set in correspondence with the air fuel ratio model in the case that the EGR rate exceeds the predetermined value x. Furthermore, a step 215 is executed in order to set the feedback gain decision flag F2 to "1" and the step 207 is then executed to set the initial value of the integrating term, further followed by the steps 209 and 210 to calculate the air fuel ratio correction coefficient FAF.

When the decision of the step 212 is that the previous control is not the open control, that is, when F1=0, a step 213 follows to check, in accordance with the feedback gain decision flag F2, whether the previous feedback gain is $IK_{EH}$. If the answer of the step 213 is that the previous EGR rate is below the predetermined value x and the present optimal feedback gain is set to $IK_{EL}$, that is, when F2=0, the step 214 follows to switch the optimal feedback gain to $IK_{EH}$. Further, in the step 215 the feedback gain decision flag F2 is set to "1" and in the step 207 the integrating term initial value is calculated, thereafter advancing to the steps 209 and 210 to calculate the air fuel ratio correction coefficient FAF. On the other hand, if the answer of the step 213 is that the previous EGR rate also exceeds the predetermined value x and the optimal feedback gain is set to $IK_{EH}$, that is, when F2=1, the operational flow directly goes to the steps 208 and the subsequent steps without executing the steps 214, 215 and 207, thereby terminating this routine after the calculation of the air fuel ratio correction coefficient FAF.

According to this embodiment, since the model constants (feedback gain and integrating constant) are switched in accordance with the EGR rate, or since the feedback gain is determined in accordance with each of the EGR rate areas and the air fuel ratio control is performed using the feedback gain corresponding to the detected EGR rate, it is possible to reduce the model error due to the variation of the air fuel ratio responsibility caused by the EGR rate variation, thereby controlling the air fuel ratio to the target air fuel ratio with a high responsibility.

Although in the above-described embodiment the EGR rate is obtained on the basis of the engine speed and the intake pressure, it is appropriate to directly detect the EGR rate by an EGR sensor. In addition, although in this embodiment the feedback gains are determined in correspondence with the two areas divided with respect to the EGR rate of 15%, it is also appropriate to determine a plurality of feedback gains corresponding to a plurality of the EGR rate areas (for example, 5 areas) and perform a switching operation between the plurality of feedback gains.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. An air fuel control apparatus for an engine, comprising:

means for detecting an air fuel ratio of an air-fuel mixture to said engine;

means for controlling a fuel supply amount to said engine;

means for recirculating an exhaust gas from an exhaust pipe of said engine to an intake pipe thereof;

means for detecting a degree of the recirculation of said exhaust gas made by said exhaust gas recirculating means;

means for determining a controlled amount of said fuel supply amount control means on the basis of an optimal feedback gain set on the basis of a dynamic model of said engine and the air fuel ratio detected by said air fuel ratio detecting means so as to control the air fuel ratio in said engine to a target air fuel ratio;

means for setting a plurality of optimal feedback gains in accordance with the degree of said reflux detected by said exhaust gas recirculating degree detecting means; and means for performing a switching operation between said plurality of feedback gains in accordance with the degree of the reflux detected by said exhaust gas recirculating degree detecting means.

2. An air fuel ratio control apparatus for an engine equipped with means for recirculating an exhaust gas from an exhaust pipe to an intake pipe, said apparatus comprising:

means for detecting an air fuel ratio of an air-fuel mixture to be introduced into said engine;

means for controlling a fuel supply amount to said engine;

means for detecting a degree of said exhaust gas which is recirculated to said intake pipe;

means for setting a plurality of optimal feedback gains on the basis of a dynamic model of a system for controlling an air fuel ratio of an air-fuel mixture to said engine;

means for selecting one of the plurality of set optimal feedback gains in accordance with the recirculating degree of said exhaust gas detected by said exhaust gas recirculating degree detecting means; and means for determining a controlled amount of said fuel supply control means on the basis of the optimal feedback gain selected by said optimal feedback gain selecting means and the air fuel ratio detected by said air fuel ratio detecting means so as to control the air fuel ratio for said engine to a target air fuel ratio.

3. An apparatus as claimed in claim 2, wherein said exhaust gas recirculating degree detecting means detects the recirculating degree of said exhaust gas on the basis of a rotational speed of said engine and an intake pressure in said intake pipe.

4. An apparatus as claimed in claim 2, wherein said optimal feedback gain selecting means selects a first optimal feedback gain of the plurality of set optimal feedback gains when the recirculating degree of said exhaust gas detected by said exhaust gas recirculating degree detecting means is above a predetermined value and selects a second optimal feedback gain of the plurality of set optimal feedback gains when the detected recirculating degree thereof is below said predetermined value.

* * * * *